US011478045B2

(12) United States Patent
Farris et al.

(10) Patent No.: US 11,478,045 B2
(45) Date of Patent: Oct. 25, 2022

(54) UPPER FOR AN ARTICLE OF FOOTWEAR AND METHOD OF LASTING THE UPPER

(71) Applicant: NIKE, Inc., Beaverton, OR (US)

(72) Inventors: Bryan N. Farris, North Plains, OR (US); Adrian Meir, Portland, OR (US); Noah Murphy-Reinhertz, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 708 days.

(21) Appl. No.: 15/928,846

(22) Filed: Mar. 22, 2018

(65) Prior Publication Data

US 2018/0271214 A1 Sep. 27, 2018

Related U.S. Application Data

(60) Provisional application No. 62/476,313, filed on Mar. 24, 2017.

(51) Int. Cl.

| | |
|---|---|
| ***A43B 13/38*** | (2006.01) |
| ***A43B 9/02*** | (2006.01) |
| ***A43B 23/02*** | (2006.01) |
| ***A43D 3/02*** | (2006.01) |
| ***D04B 1/24*** | (2006.01) |

(Continued)

(52) U.S. Cl.

CPC ..... *A43B 13/38* (2013.01); *A43B 1/04* (2013.01); *A43B 9/02* (2013.01); *A43B 23/02* (2013.01); *A43B 23/0245* (2013.01); *A43D 3/02* (2013.01); *A43D 3/022* (2013.01); *A43D 13/00* (2013.01); *A43D 21/003* (2013.01); *D04B 1/24* (2013.01); *D04B 21/207* (2013.01);

(Continued)

(58) Field of Classification Search

None

See application file for complete search history.

(56) References Cited

U.S. PATENT DOCUMENTS 2,878,523 A * 3/1959 Hardy ..... B29D 35/10 264/244
3,007,184 A * 11/1961 Makovski ..... B29D 35/061 12/145

(Continued)

FOREIGN PATENT DOCUMENTS

BE 496 754 A 11/1950
CN 202750844 U 2/2013

(Continued)

OTHER PUBLICATIONS

Office Action and English Translation in Corresponding Chinese Application No. 2018800335088, dated Dec. 11, 2020 (17 pages).

(Continued)

*Primary Examiner* — Jila M Mohandesi

(74) *Attorney, Agent, or Firm* — Shook, Hardy & Bacon, L.L.P.

(57) ABSTRACT

In one aspect, the present disclosure provides a method. The method may include placing an upper on a last, where the upper includes a lower perimeter edge secured to a lasting element, and where the last includes an opening for receiving the lasting element. The method may further include feeding the lasting element at least partially through an opening of the last and tensioning the lasting element to tighten the upper around the last by pulling the tensioning element at least partially through the opening.

6 Claims, 9 Drawing Sheets

(51) Int. Cl.

| | |
|---|---|
| ***D04B 21/20*** | (2006.01) |
| ***A43B 1/04*** | (2022.01) |
| ***A43D 21/00*** | (2006.01) |
| ***A43D 13/00*** | (2006.01) |

(52) U.S. Cl.
CPC ..... *D10B 2321/02* (2013.01); *D10B 2331/02* (2013.01); *D10B 2331/10* (2013.01); *D10B 2501/043* (2013.01)

(56) References Cited

U.S. PATENT DOCUMENTS

| | | | | |
|---|---|---|---|---|
| 3,249,955 | A * | 5/1966 | Bourassa | A43D 21/003 12/145 |
| 3,570,151 | A * | 3/1971 | Eaton | A43D 21/003 36/46.5 |
| 3,704,474 | A | 12/1972 | Winkler | |
| 5,152,025 | A * | 10/1992 | Hirmas | A43D 21/003 12/145 |
| 5,351,352 | A | 10/1994 | Chillemi | |
| 5,909,719 | A | 6/1999 | Throneburg et al. | |
| 6,014,824 | A | 1/2000 | Gumbert | |
| 6,035,555 | A * | 3/2000 | Pavelescu | A43B 7/125 36/12 |
| 6,308,438 | B1 * | 10/2001 | Throneburg | A43B 13/186 36/26 |
| 6,559,912 | B2 * | 5/2003 | Aminaka | G02B 5/3083 349/96 |
| 7,219,446 | B1 * | 5/2007 | Haimerl | A43B 7/125 12/142 T |
| 7,287,293 | B2 | 10/2007 | Cook et al. | |
| 8,595,878 | B2 * | 12/2013 | Huffa | A43B 13/14 12/145 |
| 8,839,532 | B2 | 9/2014 | Huffa et al. | |
| 9,010,157 | B1 * | 4/2015 | Podhajny | D04B 1/123 36/47 |
| 9,078,488 | B1 * | 7/2015 | Meir | D04B 1/22 |
| 9,357,813 | B2 * | 6/2016 | Lyden | A43B 13/026 |
| 9,567,696 | B2 * | 2/2017 | Huffa | A43B 23/042 |
| 9,668,533 | B2 * | 6/2017 | Dua | A43B 7/20 |
| 10,834,991 | B2 * | 11/2020 | Tamm | D04B 1/16 |
| 2005/0050769 | A1 * | 3/2005 | Haimerl | A43B 7/125 36/14 |
| 2007/0180730 | A1 * | 8/2007 | Greene | A43B 13/04 36/3 R |
| 2012/0216430 | A1 | 8/2012 | Stohr | |
| 2012/0255201 | A1 * | 10/2012 | Little | A43D 111/00 12/142 R |
| 2012/0266497 | A1 | 10/2012 | Kosta | |
| 2014/0150292 | A1 * | 6/2014 | Podhajny | A43B 23/0205 36/50.1 |
| 2014/0310986 | A1 * | 10/2014 | Tamm | A43B 13/187 36/84 |
| 2015/0005921 | A1 | 3/2015 | Droege et al. | |
| 2015/0059210 | A1 * | 3/2015 | Droege | A43B 1/04 36/84 |
| 2016/0088893 | A1 * | 3/2016 | Meir | A43B 23/0205 36/84 |
| 2016/0095377 | A1 * | 4/2016 | Tamm | D04B 1/22 36/9 R |
| 2016/0286898 | A1 * | 10/2016 | Manz | A43B 23/0205 |
| 2016/0366979 | A1 | 12/2016 | Bell et al. | |

FOREIGN PATENT DOCUMENTS

| | | | |
|---|---|---|---|
| CN | 206006177 | U | 3/2017 |
| EP | 0 900 531 | A2 | 3/1999 |
| GB | 191128373 | A | 2/1912 |

OTHER PUBLICATIONS

International Search Report dated Jun. 6, 2018 for PCT Application No. PCT/US2018/023805, 4 pages.

International Preliminary Report on Patentability in International Application No. PCT/US2018/023805, dated Oct. 3, 2019, 9 pages.

Office Action in Corresponding European Application No. 18716808.3 dated Oct. 6, 2020 (4 pages).

Office Action dated Apr. 17, 2020 for European Application No. 18716808.3, 6 pages.

Office Action received for European Patent Application No. 18716808.3, dated May 21, 2021, 4 pages.

* cited by examiner

UPPER FOR AN ARTICLE OF FOOTWEAR AND METHOD OF LASTING THE UPPER

CROSS-REFERENCE TO RELATED APPLICATIONS

This application claims the benefit of U.S. Provisional Application No. 62/476,313, filed Mar. 24, 2017, which is hereby incorporated by reference in its entirety.

BACKGROUND

A variety of articles are formed from textiles. As examples, articles of apparel (e.g., shirts, pants, socks, footwear, jackets and other outerwear, briefs and other undergarments, hats and other headwear), containers (e.g., backpacks, bags), and upholstery for furniture (e.g., chairs, couches, car seats) are often at least partially formed from textiles. These textiles are often formed by weaving or interlooping (e.g., knitting) a yarn or a plurality of yarns, usually through a mechanical process involving looms or knitting machines. One particular object that may be formed from a textile is an upper for an article of footwear.

Conventional articles of footwear generally include two primary elements: an upper and a sole structure. The upper is secured to the sole structure and forms a void within the article of footwear for comfortably and securely receiving a foot. The sole structure is secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole may be secured to a lower surface of the midsole and forms a ground-engaging portion of the sole structure that is formed from a durable and wear-resistant material.

The upper of the article of footwear generally extends over the instep and toe areas of the foot, along the medial and lateral sides of the foot, and around the heel area of the foot. Access to the void on the interior of the upper is generally provided by an ankle opening in a heel area of the footwear. A lacing system is often incorporated into the upper to adjust the fit of the upper, thereby facilitating entry and removal of the foot from the void within the upper. In addition, the upper may include a tongue that extends under the lacing system to enhance adjustability of the footwear, and the upper may incorporate a heel counter to limit movement of the heel.

BRIEF DESCRIPTION

In one aspect, the present disclosure provides a method. The method may include placing an upper on a last, where the upper includes a lower perimeter edge secured to a lasting element, and where the last includes an opening for receiving the lasting element. The method may further include feeding the lasting element at least partially through an opening of the last and tensioning the lasting element to tighten the upper around the last by pulling the tensioning element at least partially through the opening.

The method may further include the step of forming the upper by knitting a knitted component, where the knitted component at least partially defines a surface of the upper. At least a portion of the lasting element may be inlaid in a knit structure of the knitted component. Knitting the knitted component may include knitting a channel adjacent to the lower perimeter edge, and the method may further include feeding the lasting element through the channel.

The method may further comprise joining a sole structure to the lower perimeter edge of the upper. The step of joining the sole structure to the lower perimeter edge of the upper may include applying an adhesive to at least one of the lower perimeter edge of the upper and the sole structure and then contacting the lower perimeter edge of the upper with the sole structure.

The sole structure may define an underfoot surface of a void of the article of footwear when the sole structure is joined to the upper. The upper may include a bottom opening during and after the step of securing the upper to the sole structure. The method may include removing the lasting element from the article of footwear after the step of joining the sole structure to the upper.

The upper may be a non-strobel upper when the upper is incorporated into an article of footwear.

The opening in the last may extend from an underfoot side of the last to a second side of the last, and the step of feeding the lasting element may include feeding an end of the lasting element from the underfoot side of the last, through the opening of the last, and out of the second side of the last.

In another aspect, the present disclosure provides an article of footwear. The article of footwear may include a sole structure and an upper. An inner and outer surface of the upper may formed by a knitted component, where a lower perimeter edge of the upper is secured to the sole structure, and where the upper includes a bottom opening adjacent to a top surface of the sole structure.

The upper may include the bottom opening during, and after the step of securing the upper to the sole structure.

The sole structure may define an underfoot surface of a void of the article of footwear when the sole structure is joined to the upper.

The lower perimeter edge of the knitted component may be secured via an adhesive.

The upper may be secured to a lasting element, where the lasting element is configured to tighten the upper around a last when the upper is located on the last and when a tension is applied to the lasting element. The upper may include a channel formed by the knitted component in the lower perimeter edge of the upper, where the lasting element is at least partially located within the channel. An end of the lasting element may be configured to be fed through an opening of a last.

In another aspect, the present disclosure provides an article of footwear with an upper having a knitted component with a lower perimeter edge and a lasting element secured to the lower perimeter edge. The lasting element may be at least partially inlaid within a knit structure of the knitted component, where the lasting element is configured to tighten the upper around a last when the upper is located on the last and when a tension is applied to the lasting element. The lower perimeter edge may be configured to secure to a sole structure of the article of footwear.

In another aspect, the present disclosure provides a last. The last may include a last body with a first surface and a second surface, where the first surface and the second surface are configured for exposure during a lasting process for lasting an upper for an article of footwear. An opening may extend from the first surface, where the opening is configured to receive a lasting element of an article of footwear.

The opening may extend from the first surface to the second surface such that it defines a channel from the first surface to the second surface.

The last body may include a foot-shaped body, where the first surface is an underfoot surface of the foot-shaped body, and where the second surface is a top surface of the foot-shaped body.

The last may include an anchor located adjacent to, or within, the opening, and the anchor may be configured to couple to a lasting element used while lasting the upper to maintain a tension applied to the lasting element.

DETAILED DESCRIPTION

Figure 1:
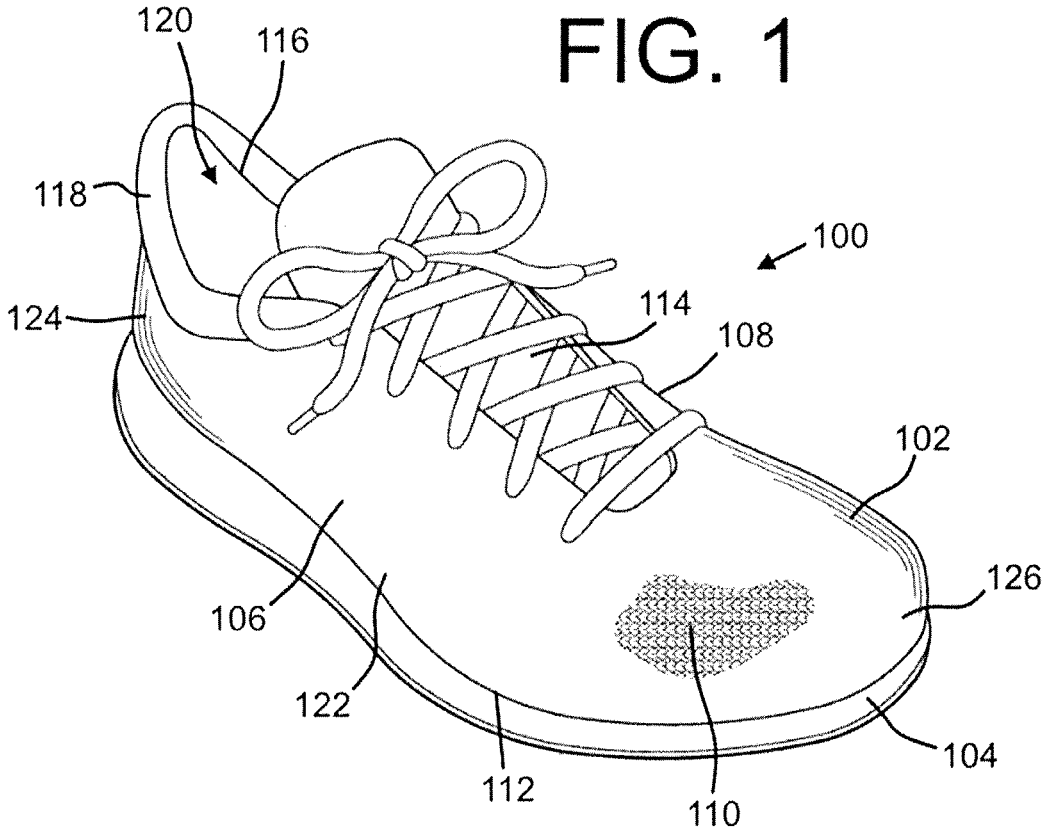
FIG. 1 shows an upper for an article of footwear in accordance with the present disclosure.

Various aspects are described below with reference to the drawings in which like elements generally are identified by like numerals. The relationship and functioning of the various elements of the aspects may better be understood by reference to the following detailed description. However, aspects are not limited to those illustrated in the drawings or explicitly described below. It also should be understood that the drawings are not necessarily to scale, and in certain instances details may have been omitted that are not necessary for an understanding of aspects disclosed herein, such as conventional fabrication and assembly.

Certain aspects of the present disclosure relate to articles at least partially formed from textiles. One example of an article is an article of apparel (e.g., shirts, pants, socks, footwear, jackets and other outerwear, briefs and other undergarments, hats and other headwear, or the like). The article may be an upper configured for use in an article of footwear. The upper may be used in connection with any type of footwear. Illustrative, non-limiting examples of articles of footwear include a basketball shoe, a biking shoe, a cross-training shoe, a global football (soccer) shoe, an American football shoe, a bowling shoe, a golf shoe, a hiking shoe, a ski or snowboarding boot, a tennis shoe, a running shoe, and a walking shoe. The upper may also be incorporated into a non-athletic shoe, such as a dress shoe, a loafer, and a sandal.

Referring to FIG. 1, an article of footwear 100 is generally depicted as including an upper 102 secured to a sole structure 104. The upper 102 may include a lateral side 106 and a medial side 108. The area of the shoe where the sole structure 104 joins the upper 102 may be referred to as the biteline 112. The upper 102 may be joined to the sole structure 104 in a fixed manner using any suitable technique, such as through the use of an adhesive, by sewing, etc. It is contemplated that the upper 102 may extend partially or completely around the foot of a wearer and/or may be integral with the sole, and a sockliner may or may not be used.

In some embodiments, the sole structure 104 includes a midsole (not shown) and an outsole. The article of footwear 100 may additionally comprise a throat 114 and an ankle opening 116, which may be surrounded by a collar 118 and may lead to a void 120. The void 120 of the article of footwear 100 may be configured to accommodate a foot of a person. The throat 114 is generally disposed in the mid-foot area 122 of the upper 102. The mid-foot area 122 is generally an area of the upper 102 located between a heel area 124 and a toe area 126.

In some embodiments, a tongue may be disposed in the throat 114 of the shoe, but a tongue is an optional component. The tongue may be any type of tongue, such as a gusseted tongue or a burrito tongue. If a tongue is not included, the lateral and medial sides of the throat 114 may be joined together. As shown, in some embodiments, the article of footwear 100 may include an optional fastening element, such as a lace (which may be associated with the lace apertures). Any suitable type of fastening element may be used.

At least a portion of the upper 102, and in some embodiments substantially the entirety of the upper 102, may be formed of a knitted component 110. The knitted component 110 may additionally or alternatively form another element of the article of footwear 100, such as an underfoot portion, for example. The knitted component 110 may have a first side forming an inner surface of the upper 102 (e.g., facing the void 120 of the article of footwear 100) and a second side forming an outer surface of the upper 102 (e.g. facing generally away from the first side). The first side and the second side of the knitted component 110 may exhibit different characteristics (e.g., the first side may provide abrasion resistance and comfort while the second side may be relatively rigid and provide water resistance, among other advantageous characteristics mentioned below). The knitted component 110 may be formed as an integral one-piece element during a knitting process, such as a weft knitting process (e.g., with a flat knitting machine or circular knitting machine), a warp knitting process, or any other suitable knitting process. That is, the knitting process may substantially form the knit structure of the knitted component 110 without the need for significant post-knitting processes or steps. Alternatively, two or more portions of the knitted component 110 may be formed separately as distinct integral one-piece elements and then the respective elements attached. In some embodiments, the knitted component 110 may be shaped after the knitting process to form and retain the desired shape of the upper (for example, by using a foot-shaped last). The shaping process may include attaching the knitted component 110 to another object (e.g., a strobel) prior to lasting. When a strobel is included, the strobel may support the upper 102 when the upper 102 is place on a foot-shaped last such that the position of the upper 102 on the last may be retained. As described in more detailed below, the present embodiments may advantageously eliminate the necessity of using a strobel.

Forming the upper 102 with the knitted component 110 may provide the upper 102 with advantageous characteristics including, but not limited to, a particular degree of elasticity (for example, as expressed in terms of Young's modulus), breathability, bendability, strength, moisture absorption, weight, and abrasion resistance. These characteristics may be accomplished by selecting a particular single layer or multi-layer knit structure (e.g., a ribbed knit structure, a single jersey knit structure, or a double jersey knit structure), by varying the size and tension of the knit structure, by using one or more yarns formed of a particular material (e.g., a polyester material, a relatively inelastic material, or a relatively elastic material such as spandex), by selecting yarns of a particular size (e.g., denier), or a combination thereof. The knitted component 110 may also provide desirable aesthetic characteristics by incorporating yarns having different colors, textures or other visual properties arranged in a particular pattern. The yarns themselves and/or the knit structure formed by one or more of the yarns of the knitted component 110 may be varied at different locations such that the knitted component 110 has two or more portions with different properties (e.g., a portion forming the throat area of the upper 102 may be relatively elastic while another portion may be relatively inelastic). In some embodiments, the knitted component 110 may incorporate one or more materials with properties that change in response to a stimulus (e.g., temperature, moisture, electrical current, magnetic field, or light). For example, the knitted component 110 may include yarns formed of a thermoplastic polymer material (e.g., polyurethanes, polyamides, polyolefins, and nylons) that transitions from a solid state to a softened or liquid state when subjected to certain temperatures at or above its melting point and then transitions back to the solid state when cooled. The thermoplastic polymer material may provide the ability to heat and then cool a portion of the knitted component 110 to thereby form an area of bonded or continuous material that exhibits certain advantageous properties including a relatively high degree of rigidity, strength, and water resistance, for example.

In some embodiments, the knitted component 110 may include one or more yarns or strands that are at least partially inlaid or otherwise inserted within the knit structure of the knitted component 110 during or after the knitting process, which are herein referred to as "tensile strands." The tensile strands may be substantially inelastic so as to have a substantially fixed length. The tensile strands may extend through a plurality of courses of the knitted component 110 or through a channel or passage formed within the knitted component 110 and may limit the stretch of the knitted component 110 in at least one direction. For example, the tensile strands may extend from an area underfoot, and/or approximately from a biteline of the upper 102 to a throat area of the upper 102 to limit the stretch of the upper 102 in the lateral direction. The tensile strands may form one or more lace apertures for receiving a lace and/or may extend around at least a portion of a lace aperture formed in the knit structure of the knitted component.

Figure 2:
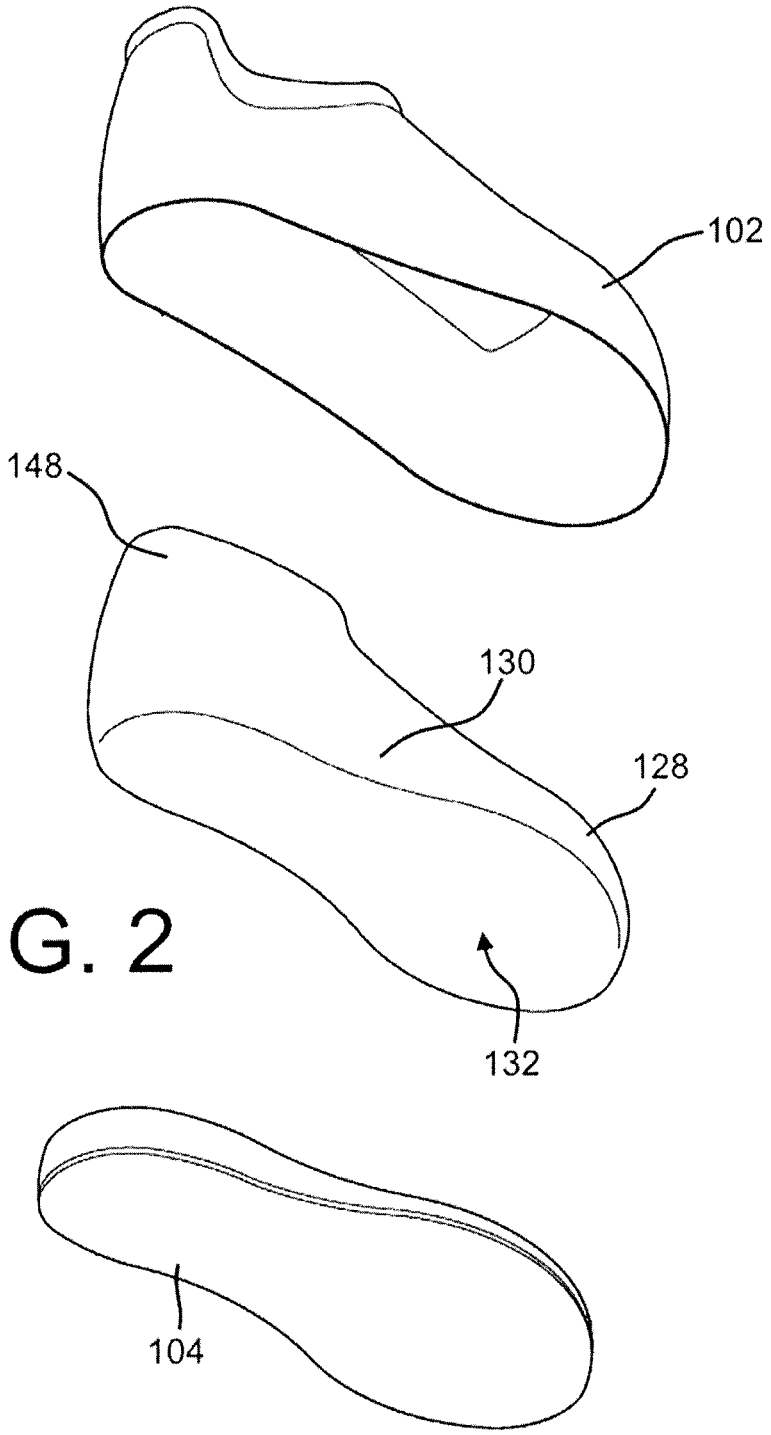
FIG. 2 shows an upper of the article of footwear of FIG. 1, a foot-shaped last, and a sole structure (each in isolation).

FIG. 2 shows the upper 102 prior to being secured to the sole structure 104. The upper 102 is depicted just prior to being placed on a last 128, which may have a foot-shaped body 130. Alternatively, the body 130 may have a shape other than the shape of a foot in some embodiments. The foot-shaped body 130 may have an elevated portion 148 (which may, but does not necessarily, include the shape of an ankle and/or lower leg). The foot-shaped body 130 may be a solid and unitary component, or it may have one more movable element such that the size and/or the shape of the foot-shaped body 130 may vary upon adjustment.

Figure 3:
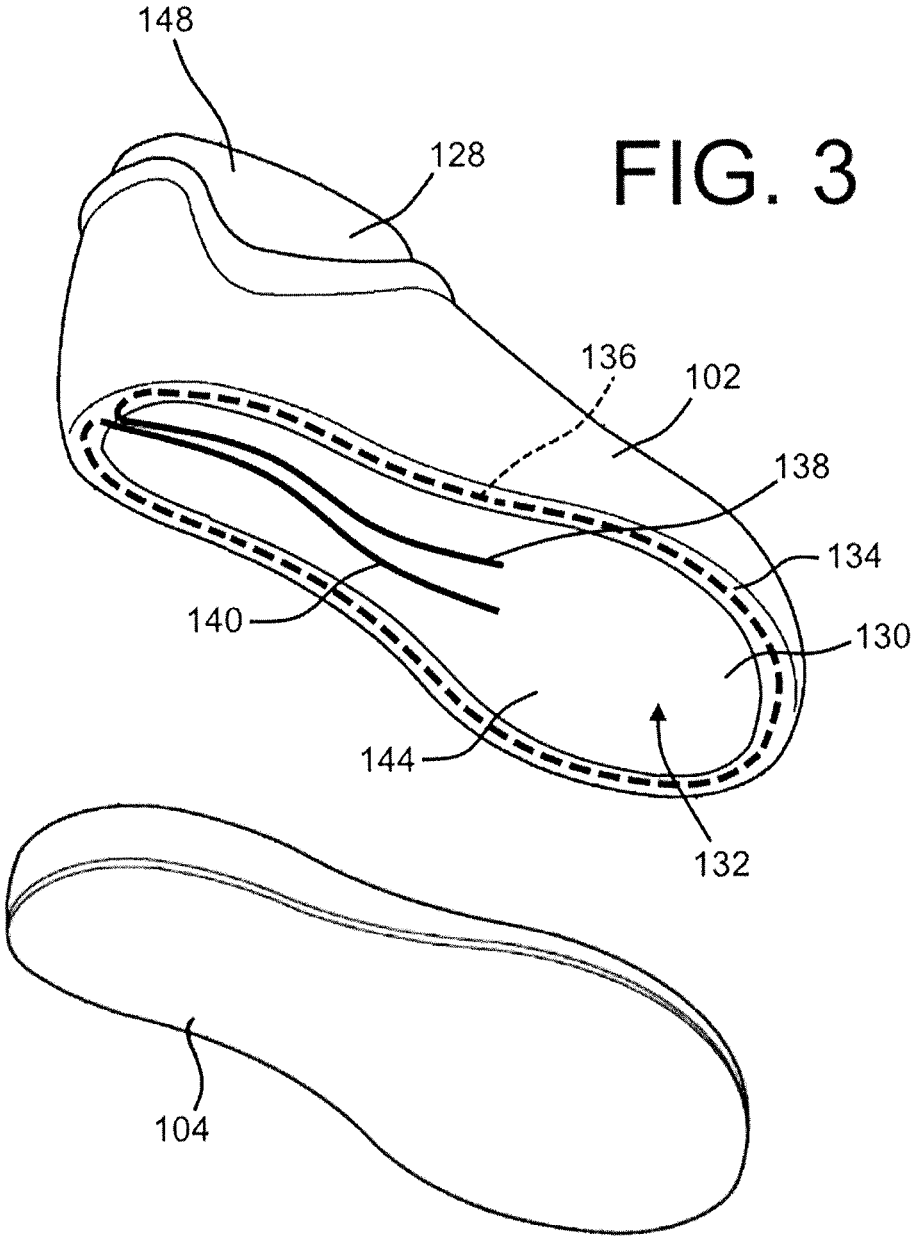
FIG. 3 shows the upper of FIG. 2 placed on the foot-shaped last of FIG. 2, where the upper has a lasting element in accordance with the present disclosure.

As shown in FIG. 3, the upper 102 may be placed on the last 128 during the manufacturing process of the article of footwear. The upper 102 may cover portions of the last 128 corresponding with the lateral and medial side of the foot, the upper surface of the foot, and the heel area of the foot, as shown. At this stage of the manufacturing process, at least a portion of the foot-shaped body 130 corresponding with the underfoot surface (i.e., the plantar surface) of the foot may be exposed, here depicted as bottom surface 132. Thus, a perimeter edge 134 may form an aperture or bottom opening 144 in the upper 102 where the bottom surface 132 of the foot-shaped body 130 is exposed. The perimeter edge 134 may extend over a portion of the bottom surface 132, and/or at least a portion of the perimeter edge 134 may terminate on a side of the foot-shaped body 130 prior to reaching the bottom surface 132.

In some embodiments, at least during the manufacturing process, the upper 102 may include, or be secured to, a lasting element configured to tighten the upper 102 around a last. Several embodiments of uppers with lasting elements are described in U.S. patent application Ser. No. 12/848,352, which issued as U.S. Pat. No. 8,595,878 on Dec. 3, 2013, and which is herein incorporated by reference in its entirety.

One example of a lasting element 136 secured to (or included within) the upper 102 is shown in FIG. 3. The lasting element 136 may be secured to the perimeter edge 134 of the upper 102, and may be secured in a movable manner with respect to the perimeter edge 134 such it may be pulled or otherwise tensioned to pull on the perimeter edge 134 while the upper 102 is on the last 128. Thus, the effect of tensioning the perimeter edge 134 may be similar to that of a drawstring. Tensioning the lasting element 136 may tighten the upper 102 around the foot-shaped body 130 such that the upper 102 acquires a shape similar to that of a foot. This tension within the lasting element 136 may be accomplished by pulling on at least one of the first end 138 and the second end 140 of the lasting element, for example.

Figure 4:
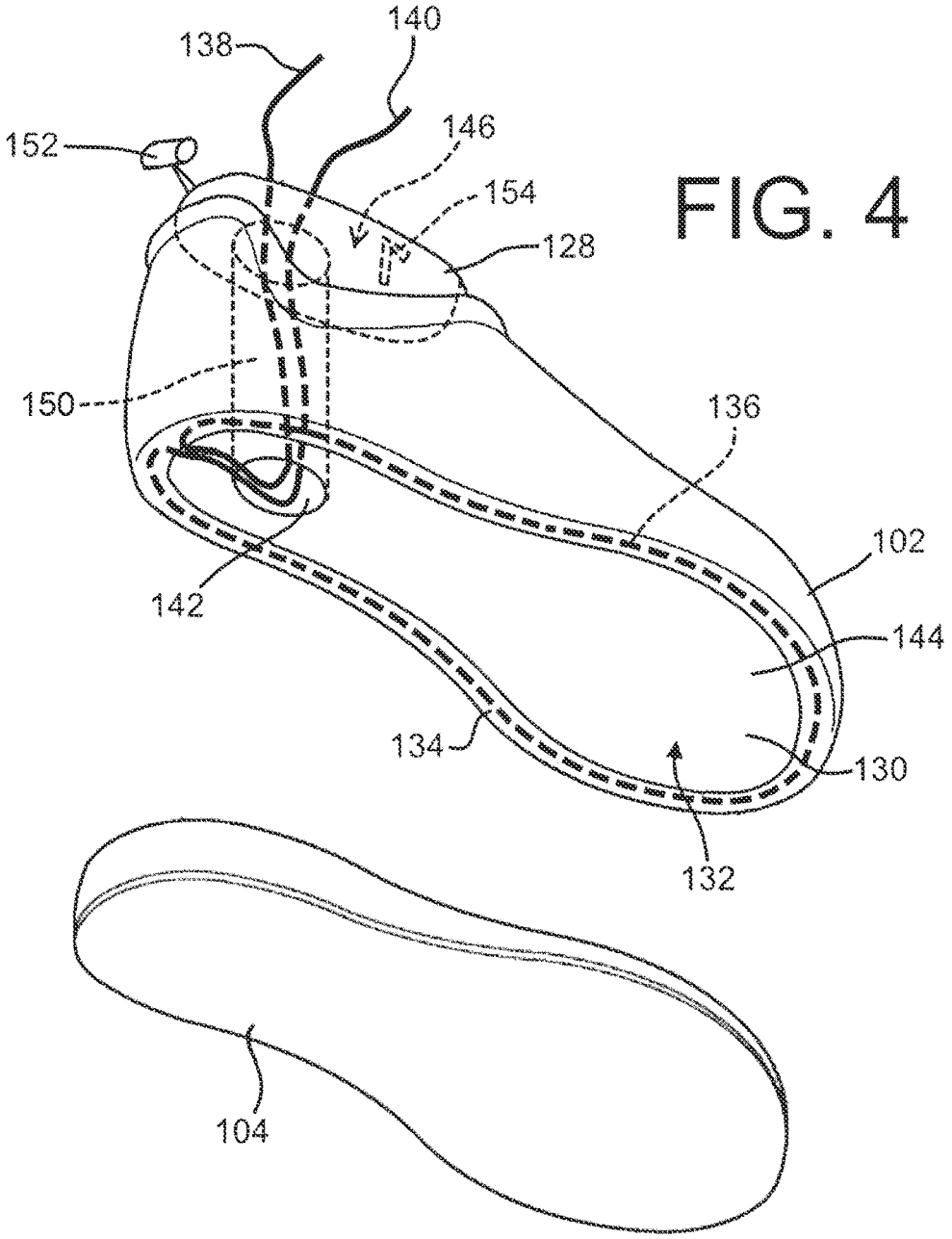
FIG. 4 shows the upper with the lasting element of FIG. 3, where portions of the lasting element are fed through an opening in the last in accordance with the present embodiments.

As shown in FIG. 4, the last 128 may include an opening 142 configured to receive at least one end (i.e., at least one of the first end 138 and the second end 140) of the lasting element 136. The opening 142 may be located on the bottom surface 132 of the foot-shaped body 130. In exemplary embodiments, the opening 142 is located at a portion of the bottom surface 132 (also referred to as a "first surface") that typically remains exposed during the lasting process, which may be advantageous for ensuring that the opening 142 is accessible by a person controlling and/or overseeing manufacturing. The opening may extend to a second surface 146 of the last 128, which may be a surface that is also typically exposed during the lasting process. As depicted in FIG. 4, the second surface 146 may be a surface on an exposed area of the elevated portion 148 of the foot-shaped last 128. Thus, the opening may form a tunnel or passage 150 from the bottom surface 132 to the second surface 146, which may be traversed by at least a portion of the lasting element 136 (such as the first end 138 and/or the second end 140).

After securement of the upper 102 to the sole structure 104, and potentially before the upper 102 is removed from the last 128, the lasting element 136 may be removed from the upper 102. This may be accomplished by pulling on only one of the first end 138 and the second end 140 with a force sufficient to maneuver the lasting element 136 out of the upper 102 (e.g., when the upper 102 includes a knit tube that houses the lasting element 136 as described in more detail below). Additionally or alternatively, the lasting element 136 may be severed by a knife or other object to facilitate removal. It is also contemplated that the lasting element 136 may be formed of a dissolvable and/or degradable material that dissolves when exposed to a chemical (such as water). Thus, the lasting element 136 may be removed from the upper 102 through dissolution when exposed to water (or another chemical) at a particular step.

During the lasting process, the first end 138 and the second end 140 may be fed through the opening 142 of the last 128 and out of the second surface 146, as shown in FIG. 4. Tension may then be applied to at least one of the first end 138 and the second end 140 from above the second surface 146 such that the upper 102 is pulled and formed generally into the shape of the foot-shaped body 130. The tension may be applied manually (e.g., by hand), automatically (e.g., using a reel 152 connected to an electronic motor or other automatic device), or by any other suitable means. To aid manual tensioning, the last 128 may include an anchor 154 that may engage the lasting element 136 to maintain its tension once it is applied. The anchor may include a hook, a clamp, a peg, a catch, or any other suitable device.

Alternatively, it is contemplated that the opening 142 may extend only to the bottom surface 132, and the last 128 may include a tensioning system that pulls on the lasting element 136 into a cavity at least partially defined by the opening 142. Any suitable tensioning system may be used, such as a reel, and the tensioning system may be operated automatically (e.g., incorporating electronic components) or manually through mechanical means.

During or after pulling the upper 102 taught around the foot-shaped body 130, a lower component, such as a strobel or and/or the sole structure 104, may be secured to the upper 102. In exemplary embodiments, the sole structure 104 is secured to the upper 102 without a strobel (and, for purposes of this disclosure, the strobel would be considered part of the upper 102 if included). The upper 102 may be said to be a non-strobel upper if it is configured such that it can be suitably lasted and suitably secured to the sole structure 104 without a strobel. Accordingly, the upper 102 may include the bottom opening 144 prior to, during, and after securement to the sole structure 104, including after completion of the manufacturing process of the article of footwear. In this embodiment, the sole structure 104 may form a bottom surface of the void of the article of footwear (e.g., since a strobel does not cover the opening 144 such that it is exposed from a top perspective). Herein, "top" refers to the traditional top or "up" direction when an article of footwear is sitting sole-down on the ground, and "bottom" refers to the opposite direction. Advantageously, the exclusion of a strobel may save material costs, may provide the ability to manufacture a relatively lightweight, high-performance article of footwear (including with a knitted upper), and may provide more flexibility in the design of the sole structure 104 and/or the upper 102. An article of footwear without a strobel covering the opening 144 (e.g., such that the top surface of the sole structure is accessible) may be said to be strobelless.

The securement of the upper 102 to the sole structure 104 may occur at least at the lower perimeter edge 134, and particularly where the lower perimeter edge 134 overlaps the bottom surface 132 of the foot-shaped body 130. Any suitable securement means may be used to secure the upper 102 to the sole structure 104, such as stitching, thermal bonding, adhesive bonding, a combination thereof, etc. Advantageously, the embodiment of FIG. 4 may provide the ability for the upper 102 to remain taught during the securement step. The ability to access the lasting element 136 during the securement process without reaching between the upper 102 and the sole structure 104 may also allow for tension of the lasting element 136 (and therefore the tightness of the upper 102) to be adjusted dynamically during or just before securement. This adjustment may either be by design or to correct misalignments, for example. Further, since the first end 138 and the second end 140 are accessible without directly extending between the perimeter edge 134 and the sole structure 104, the securement process may occur without sacrificing any surface area of contact between the perimeter edge 134 and the sole structure 104, thereby providing a structurally-sound joint between those elements. The importance of these advantages may be enhanced where it is desirable for the degree of overlap between the perimeter edge 134 and the sole structure 104 to be as small as possible (to save material and ensure the perimeter edge 134 does not interrupt the comfort and/or function of the sole structure 104, for example). In some embodiments, for example, from about 2 mm to about 20 mm, such as from about 5 mm to about 15 mm (e.g., 10 mm) of the perimeter edge 134 may overlap and/or contact the sole structure 104 when the upper 102 is incorporated into an article of footwear. The perimeter edge 134 may be secured to the sole structure 104 through the use of an adhesive, by stitching, and/or by another suitable device or method for securement.

While it may be advantageous to minimize manufacturing steps, other manufacturing steps may occur while the upper 102 is located on the last 128. For example, while the upper 102 is on the last, heat may be applied to the upper 102, which may fuse certain material within the yarns of the knitted material of the upper 102 or otherwise stiffen the upper 102 such that it retains a suitable shape after removal from the last 128. The heat may be applied in the form of steam. The steaming or other heating step may occur prior to, during, or after the step of securing the upper 102 to the sole structure 104. Additional last-assisted manufacturing steps are also contemplated (for example, pressing a logo or other component onto the upper 102).

The above-described embodiments may additionally or alternatively be advantageous for providing the ability to customize sizing (and shaping) of the article of footwear without significantly modifying the knitting process. For example, the size of the upper 102 may be determined by the size/shape of the last 128, the tension applied to the lasting element 136, the level of heat applied to the upper 102 when lasted, a combination thereof, etc. This may reduce or eliminate the necessity to incorporate multiple knitting machines, needle sizes, yarn sizes, etc. when developing and manufacturing a model of article of footwear with multiple sizes and shapes (which may potentially be customized for particular users).

Figure 5:
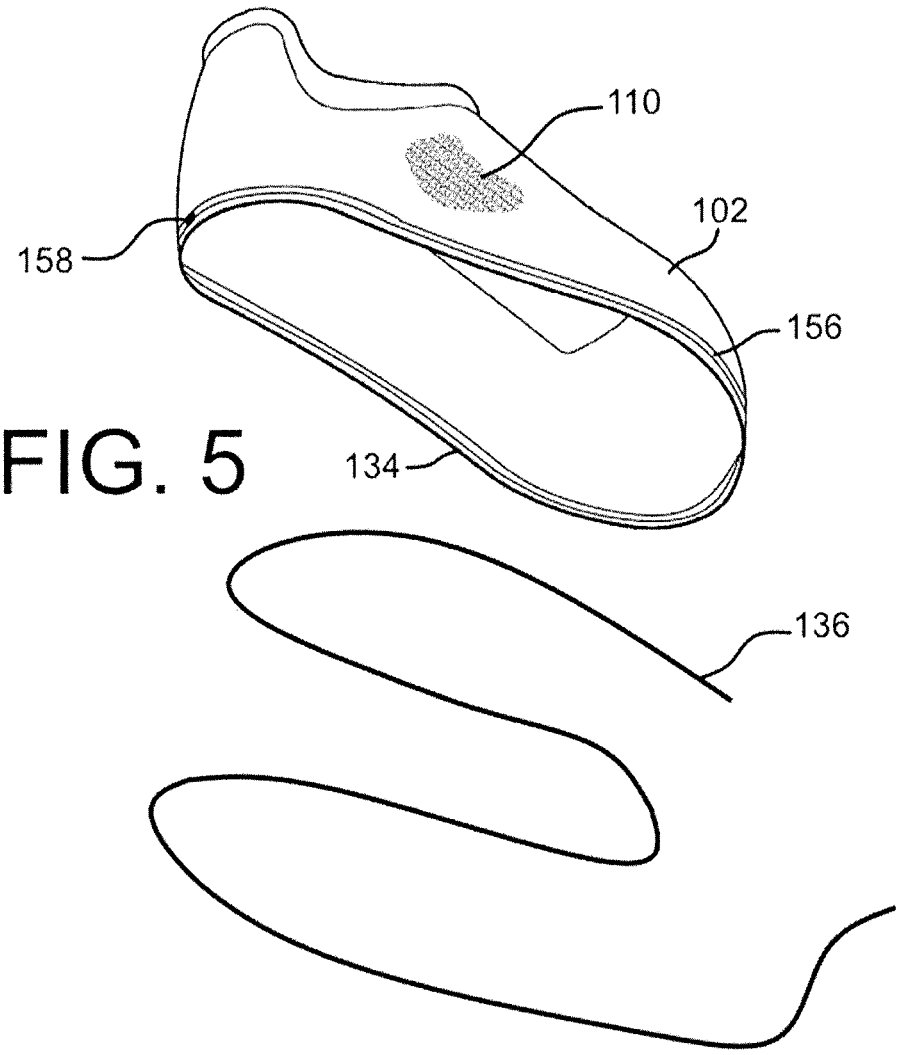
FIG. 5 shows the upper of FIG. 4 prior to securing the lasting element of FIG. 4 to the upper.

Referring to FIG. 5, the lasting element 136 may be secured to the upper 102 after the upper 102 is formed. For example, if the upper 102 is primarily formed by a knitted component 110, the knitted component 110 may include a channel 156 around the perimeter edge 134. The channel 156 may be formed by any suitable method or structure. In one example, the channel 156 may be formed by using a tubular knitting process when knitting the perimeter edge 134, where a first layer is knit on a first needle bed of a knitting machine and a second layer is formed on a second needle bed of a knitting machine, and then those two layers are secured at two edges to define the channel 156. Once the channel 156 is formed, the lasting element 136 may be fed through the channel 156. An opening 158 may be created (e.g., by cutting) or may be formed by a knitted gap in the knit structure of the knitted component 110.

Figure 6:
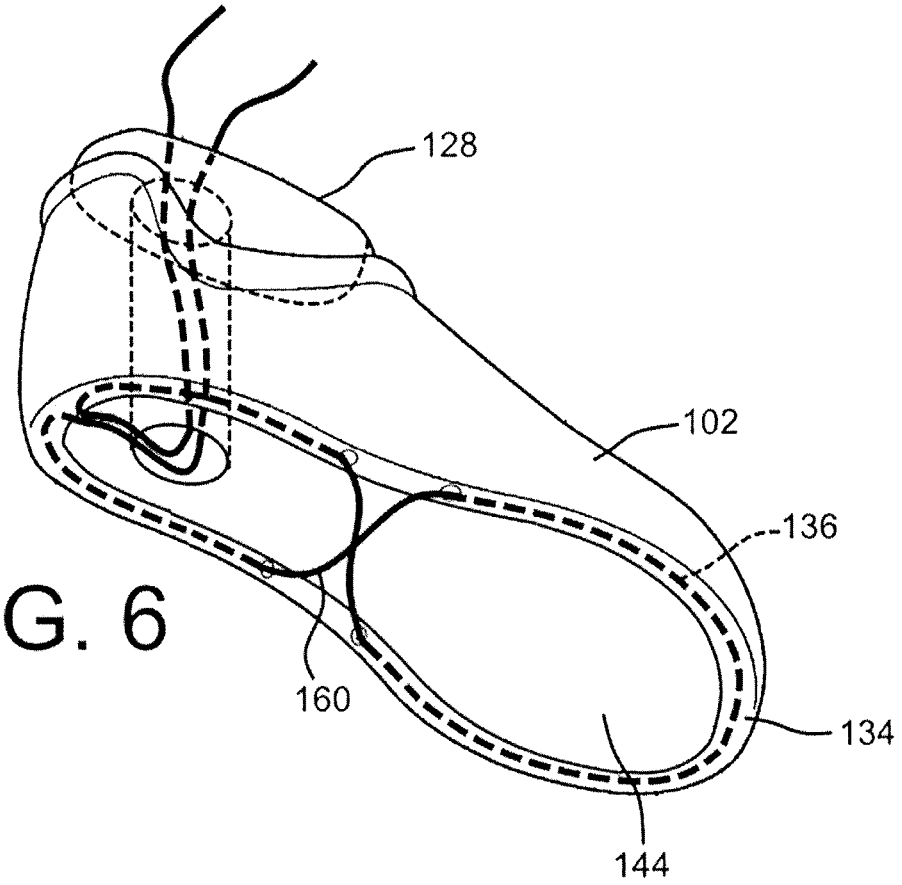
FIG. 6 shows another embodiment of an upper where a lasting element crosses from one side of a bottom opening of the upper to another side of the bottom opening of the upper in accordance with the present disclosure.

While not required, it is contemplated that the upper 102 may include a lasting element 136 having one or more portions 160 that cross from the perimeter edge 134 at one side of the upper 102 (e.g., the medial side) to the perimeter edge 134 at another side of the upper 102 (e.g., the lateral side), as depicted in FIG. 6. The portions 160 may be said to cross over the bottom opening 144 of the upper 102. The arrangement of the portions 160 may provide varied tension of the upper 102 around the last 128 such that some areas of the perimeter edge 134 are pulled with more tension and/or in a different direction than other areas of the perimeter edge 134, which may be advantageous for allowing the shape of the upper 102 to be controlled with enhanced precision. This particular arrangement of the lasting element 136 may be accomplished by crossing the lasting element 136 from one portion of the perimeter edge 134 to another when feeding the lasting element through the channel 156 of FIG. 5 (which may require forming additional channel openings). Additional portions that cross from one side of the upper 102 to another may be located in different locations (e.g., closer to the toe or heel), and any suitable number of such portions may be included. Advantageously, the portions that cross from one side of the upper 102 to another may be located and configured such that the tension provided to the upper 102 varies at different locations of the upper 102 for suitable tension control.

Figure 7:
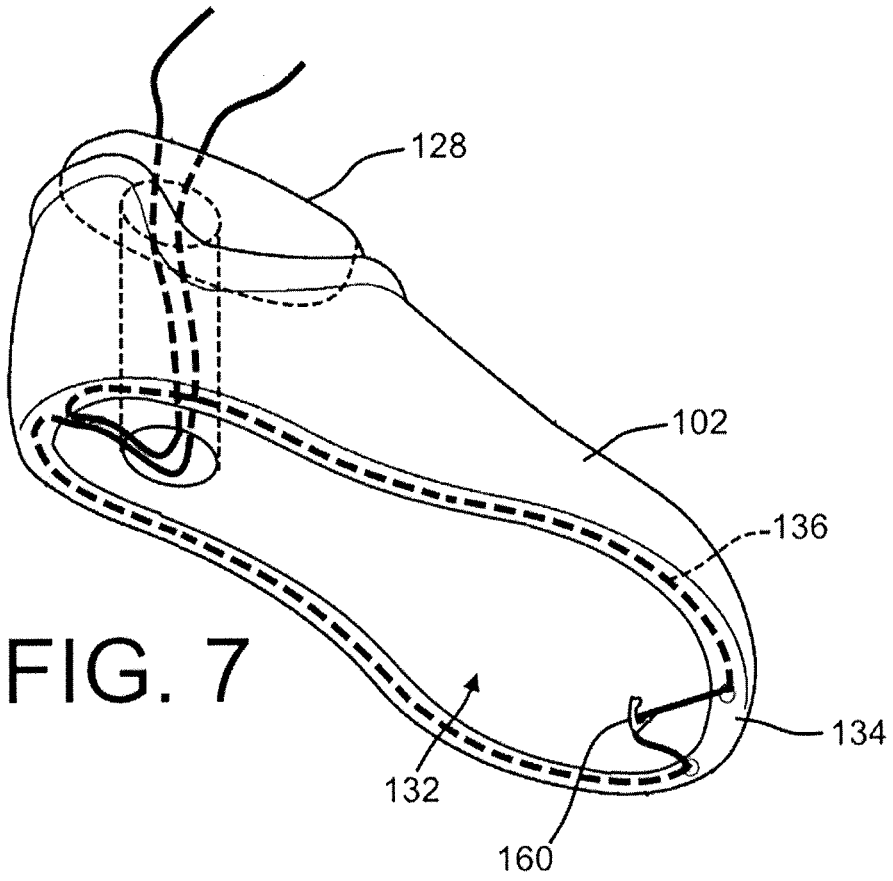
FIG. 7 shows another embodiment of an upper where a tensioning element is coupled to a hook of a last in accordance with the present disclosure.

Similarly, as shown in FIG. 7, a lasting element 136 may be coupled to a hook 162, which may extend from the bottom surface 132 of the last 128. This arrangement of the lasting element 136 may be accomplished by wrapping the lasting element 136 around the hook 162 when during the step of feeding the lasting element 136 through the channel 156. It is contemplated that the hook 162 may be retractable such that it may release the lasting element 136 once the upper 102 is secured to a sole structure, which may be advantageous for facilitating removal of the upper 102 from the last 128 after securement. The hook 162 may also be located in a depression or cavity on the bottom surface 132 such that it does not interrupt securement between the upper 102 and the sole structure 104. It is also contemplated that the hook 162 may include a sharp edge configured to cut the lasting element 136 such that the lasting element 136 may be removed from the upper 102 if and when it is no longer needed. While not shown, it is also contemplated that a retractable or non-retractable hook (e.g., a needle or other suitable device) may be attached to the lower perimeter edge 134 at least at one location to provide additional support prior to, during, or after the lasting process.

Figure 8:
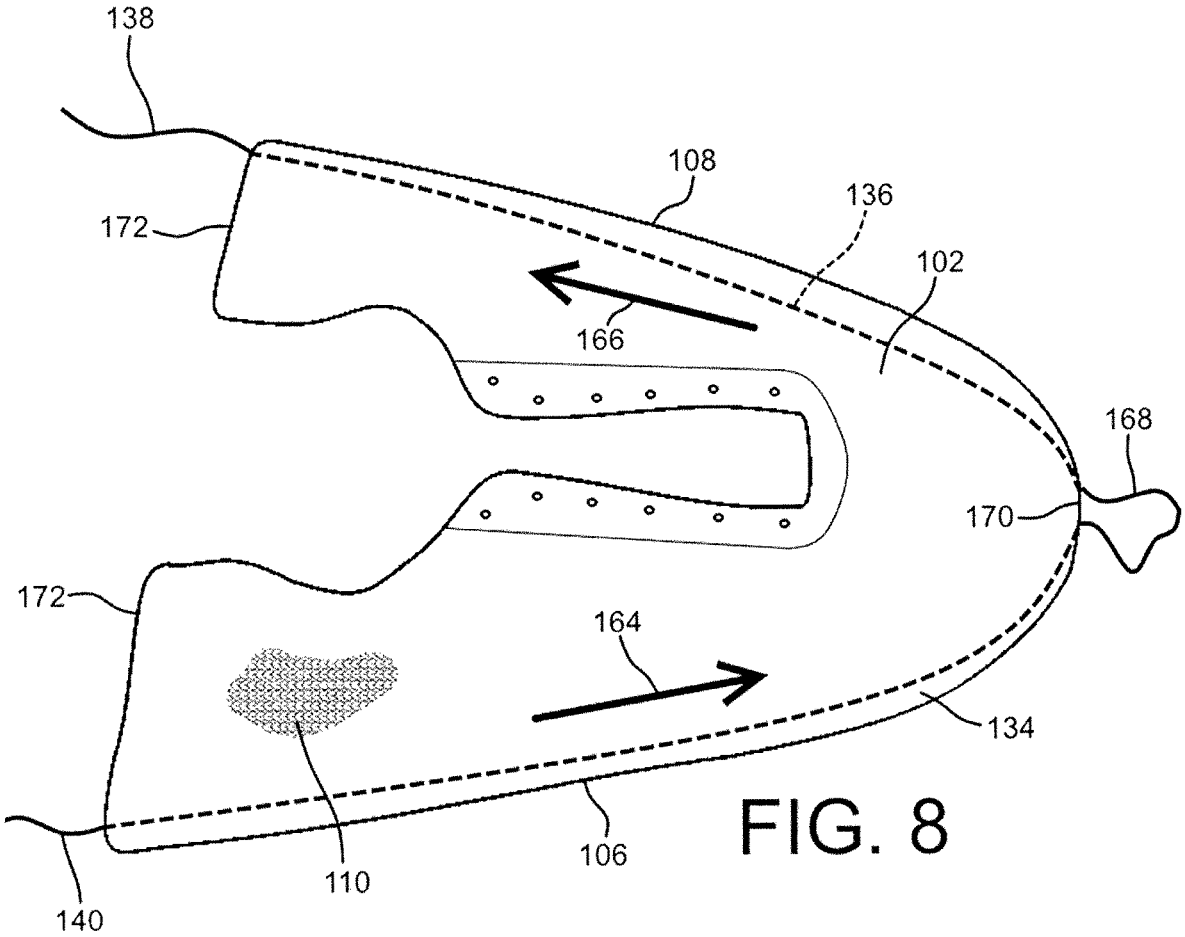
FIG. 8 shows an upper having a knitted component, where a lasting element is inlaid within the knit structure of the knitted component in accordance with the present disclosure.

Referring to FIG. 8, the lasting element 136 may be formed as an element/portion of the knitted component 110, where the knitted component 110 forms at least a portion of the upper 102. In other words, the lasting element 136 may be formed on a knitting machine with the rest of the knitted component 110 and may be integrated into the knit structure of the knitted component 110. For example, in one non-limiting example, the lasting element 136 may be inlaid within courses and/or wales of the knitted component such that it passes through the loops of various courses and/or wales. When inlaid within courses, the lasting element 136 may alternate between being located (a) behind some of the loops of the course and (b) in front of other loops of the course, for example as described with reference to FIG. 8A of U.S. Pat. No. 8,839,532, which is hereby incorporated by reference in its entirety.

In embodiments where the upper 102 is knitted generally from the lateral side 106 to the medial side 108, the lasting element 136 may be inlaid in a first direction (depicted in FIG. 8 by arrow 164) at a perimeter edge 134 on the lateral side 106, and then may return as an inlaid element on the medial side 108 in a generally-opposite second direction (depicted by arrow 166). This orientation may allow the inlay process to take place on a single or multi-bed flat knitting machine. When this procedure is used, a slack portion 168 may be located at a location 170 of the perimeter edge 134 when the knitted component initially comes off the knitting machine. The slack portion may represent the step during knitting where a feeder inlaying the lasting element 136, when moving in the first direction, reaches the end of the upper 102, extends past the upper 102, and then turns into the second direction to move back towards its original position. The slack portion 168 may be removed by pulling on at least one of the first end 138 and the second end 140 of the lasting element 136 after removing the knitted component 110 from the knitting machine, for example.

In FIG. 8, the upper 102 is depicted as having two rear edges 172 that may be joined (e.g., by sewing a seam) prior to placing the upper 102 onto a last, but it is also contemplated that the upper 102 may be formed with a shape suitable such that no seams within the upper 102 are necessary. While not required in all embodiments, the two rear edges 172 may be configured such that a formed seam (when the upper 102 is fully formed) is not directly behind the heel of the article of footwear, but is rather offset.

Figure 9:
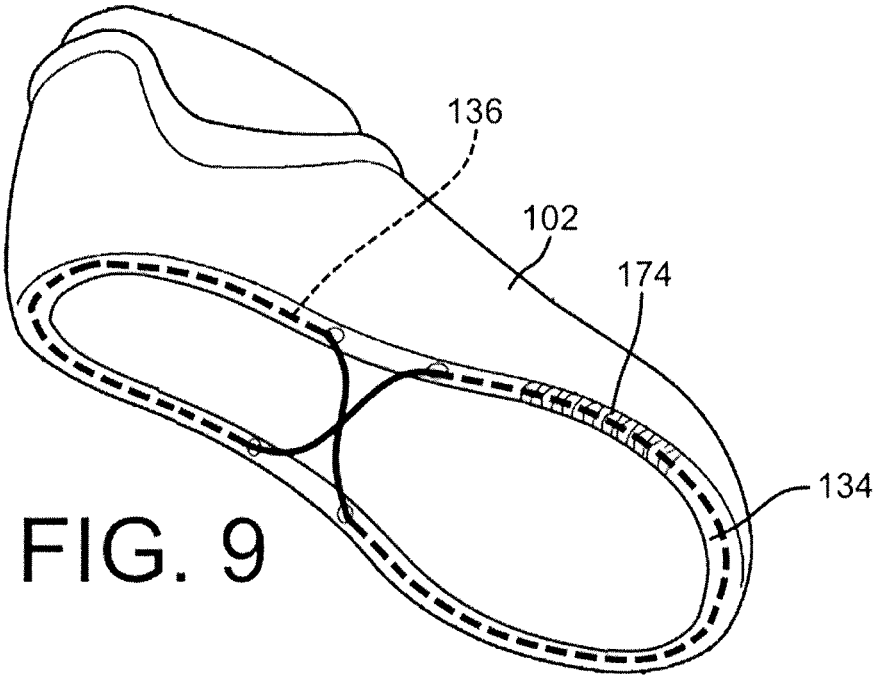
FIG. 9 shows an upper secured to a closed-loop lasting element in accordance with the present disclosure.

As shown in FIG. 9, the upper 102 may include a closed-loop lasting element 136 without any discontinuous ends. The lasting element 136 may be secured to the upper 102 using any of the methods described above. It is contemplated that the lasting element 136 may be secured to the upper 102 initially with at least two discontinuous ends, and then those discontinuous ends secured to one another after (or during) securement of the lasting element 136. Alternatively, the lasting element 136 may be a closed-loop when initially secured. This may be accomplished by tying the lasting element 136 to a lower perimeter edge 134 of the upper with a plurality of tie yarns 174, as shown. The tie yarns may optionally incorporate into the knit structure of the knitted component 110 of the upper 102. Other suitable means of securement are also contemplated, such as bonding by adhesive or sewing, for example.

While not required, the closed-loop lasting element 136 of FIG. 9 may include a relatively elastic material, such as rubber or spandex, which may facilitate placing of the upper 102 on the last. The lasting element and/or the upper may be configured (e.g., sized) such that when the upper 102 is placed on a last, the lasting element 136 experiences a tension, thereby tightening the upper 102 around the last. As described in detail above, a sole structure or other lower element may then be secured to the upper 102. The lasting element 136 may then optionally be severed and removed. In some embodiments, the elastic lasting element may elongate at least twice as much as the elongation of the yarns/strands forming most of the remainder of the upper 102 when subjected to the same tensile force (e.g., such as a 5 pound force on a tensometer).

In the present disclosure, the ranges given either in absolute terms or in approximate terms are intended to encompass both, and any definitions used herein are intended to be clarifying and not limiting. Notwithstanding that the numerical ranges and parameters setting forth the broad scope of the present embodiments are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Furthermore, the present disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the present disclosure and without diminishing its intended advantages. It is therefore intended that such changes and modifications be covered by the appended claims.

We claim:

1. A knitted component defining an upper for an article of footwear, comprising:

an upper portion that includes a lower perimeter edge;

a tubular knitted structure defining at least one channel that extends about the lower perimeter edge of the upper portion, wherein the tubular knitted structure and the upper portion comprise an integral one-piece knitted element, and wherein the at least one channel includes a first opening, a second opening, and a third opening, wherein the third opening is located at a toe end of the upper portion;

a lasting element positioned within the at least one channel, the lasting element comprising a first end, a second end, and a slack portion, wherein the first end of the lasting element is extended out of the first opening, wherein the second end of the lasting element is extended out of the second opening, wherein the slack portion of the lasting element is extended out of the third opening, and wherein the lasting element is movable within the at least one channel.

2. The knitted component defining an upper for an article of footwear of claim 1, wherein the lower perimeter edge is secured to a sole structure of the article of footwear.

3. The knitted component defining an upper for an article of footwear of claim 1, wherein the third opening in the at least one channel is formed by a gap in the knitted component.

4. The knitted component defining an upper for an article of footwear of claim 1, wherein the lasting element comprises a dissolvable material.

5. The knitted component defining an upper for an article of footwear of claim 4, wherein the dissolvable material is a water-dissolvable material.

6. The knitted component defining an upper for an article of footwear of claim 1, wherein the lasting element comprises a degradable material.

* * * * *